US009930911B1

(12) United States Patent
Wright

(10) Patent No.: US 9,930,911 B1
(45) Date of Patent: Apr. 3, 2018

(54) WATER PIPE BOWL ASSEMBLY

(71) Applicant: Nathaniel M. Wright, Haiku-Pauwela, HI (US)

(72) Inventor: Nathaniel M. Wright, Haiku-Pauwela, HI (US)

( * ) Notice: Subject to any disclaimer, the term of this patent is extended or adjusted under 35 U.S.C. 154(b) by 780 days.

(21) Appl. No.: 14/321,815

(22) Filed: Jul. 2, 2014

(51) Int. Cl.
*A24F 5/00* (2006.01)
*A24F 1/30* (2006.01)

(52) U.S. Cl.
CPC . *A24F 5/00* (2013.01); *A24F 1/30* (2013.01)

(58) Field of Classification Search
CPC ..... A24F 1/30; A24F 5/00; A24F 5/04; A24F 1/02; A24F 1/04; A24F 1/10; A24F 47/00; A24F 5/02; A61M 15/06
USPC ..... 131/214, 226, 173; D27/162, 167, 166
See application file for complete search history.

(56) References Cited

U.S. PATENT DOCUMENTS 4,014,353 A * 3/1977 Kahler ..... A24F 1/30 131/173
4,257,432 A * 3/1981 Griffith ..... A24F 1/30 131/173
4,788,988 A * 12/1988 Titus ..... A24F 1/30 131/173
8,459,269 B2 * 6/2013 Zoumut ..... A24F 1/30 131/173
9,445,630 B1 * 9/2016 Modi ..... A24F 1/30
2008/0060663 A1 * 3/2008 Hamade ..... A24F 1/30 131/178
2009/0084391 A1 * 4/2009 Krupp ..... A24F 1/30 131/173
2010/0326453 A1 * 12/2010 Chaoui ..... A24F 1/30 131/173
2012/0111345 A1 * 5/2012 Sweitzer ..... A24F 1/30 131/173

(Continued)

FOREIGN PATENT DOCUMENTS

EP 2719294 A1 * 4/2014 ..... A24F 1/30
WO WO 2010061233 A2 * 6/2010 ..... A24F 1/30
WO WO 2014118787 A1 * 8/2014 ..... A24F 1/30

OTHER PUBLICATIONS

McGraw Hill, Concise Encyclopedia of Science and Technology, Third Edition, McGraw Hill INc. 1999-2000, p. 858-859.*

*Primary Examiner* — Michael H. Wilson
*Assistant Examiner* — Sonny V Nguyen
(74) *Attorney, Agent, or Firm* — Michael W. Goltry; Robert A. Parsons; Parsons & Goltry

(57) ABSTRACT

A water pipe bowl assembly includes a hollow adapter having a connector and an opposed insert, and a bowl support extends radially outward from hollow adapter between the connector and the insert. A hollow bowl fixture is positioned on the bowl support and over the insert, and includes inwardly-directed upper flange encircling the closed outer end of the insert, an inwardly-directed lower flange encircling the inner end of the insert, and a smoke-collection chamber between the upper and lower flanges through which the insert extends from the inner end to the closed outer end. The upper flange and the closed outer end of the insert form a bowl for receiving a substance to be smoked and a smoke-inhalation pathway from the bowl to the smoke-collection chamber, and the opening through insert is for transferring inhalation smoke from the smoke-collection chamber to the hollow adapter.

7 Claims, 6 Drawing Sheets

(56) References Cited

U.S. PATENT DOCUMENTS

| | | | | |
|---|---|---|---|---|
| 2013/0039639 | A1* | 2/2013 | Carney | A61L 9/03<br>392/386 |
| 2014/0069446 | A1* | 3/2014 | Haddad | A24F 1/30<br>131/329 |

* cited by examiner

WATER PIPE BOWL ASSEMBLY

FIELD OF THE INVENTION

The present invention relates to water pipes used by smokers to inhale the products of combustion of combustible substances such as tobacco, herbs, and fruits, and, more particularly, to a bowl assembly for a water pipe to hold combustible substances for smoking.

BACKGROUND OF THE INVENTION

The use of water in smoking implements is well known, in which smoke from a substance combusting in a bowl is drawn through a container of water from a smoke inlet tube connected to the bowl to a drawtube to the mouth of the smoker. Drawing the smoke through the water cools the smoke, and filters ash, tars, and other contaminants from the smoke. A typical water pipe includes container for holding the water, a bowl for the smoking substance, a smoke inlet tube coupled between the bowl and the container at a point beneath the water applied to the container, and a drawtube for the passage of smoke from the water to the mouth of the smoker. The bowls of modern version of water pipes easily clog, are difficult to clean between uses, and tend to produce excessive ash buildup in the water necessitating frequent changing of the water. Accordingly, there is a need in the art for an improved bowl assembly that solves at least these problems.

SUMMARY OF THE INVENTION

According to the principle of the invention, in a water pipe including a water container coupled between a drawtube and a smoke inlet tube, improvements therein include a bowl assembly including a hollow adapter and a hollow bowl fixture. The hollow adapter has a first section connected to the smoke inlet tube and an opposed second section, and a bowl support extends radially outward from hollow adapter between the first and second sections. The second section includes an inner end near the bowl support, a closed outer end, and an opening through second section between the inner end and the closed outer end. The hollow bowl fixture is positioned on the bowl support and over the second section. The hollow bowl fixture includes a continuous sidewall that extends from an inwardly-directed upper flange encircling the closed outer end of the second section on an outer side of the opening to an inwardly-directed lower flange encircling the inner end of the second section on an inner side of the opening, and a smoke-collection chamber between the inwardly-directed upper flange and the inwardly-directed lower flange through which the second section extends from the inner end of the second section to the closed outer end of the second section. The inwardly-directed upper flange cooperates with the closed outer end of the second section to form a bowl for receiving a substance to be smoked and a smoke-inhalation pathway between the inwardly-directed upper flange and the closed outer end of the second section for the passage of inhalation smoke therethrough from the bowl to the smoke-collection chamber. The opening through second section between the inner end and the closed outer end is for the passage of inhalation smoke therethrough from the smoke-collection chamber to the hollow adapter for application to the smoke inlet tube of the water pipe. The first section is connected to the smoke inlet tube via insertion of the first section into an open smoke inlet end of the smoke inlet tube. The hollow adapter is integrally formed of glass, and the hollow bowl fixture is integrally formed of glass.

According to the principle of the invention, there is a bowl assembly for a water pipe including a water container coupled between a drawtube and a smoke inlet tube. The bowl assembly includes a hollow adapter and a hollow bowl fixture. The hollow adapter includes a first section adapted to be removably connected to the smoke inlet tube and an opposed second section, and a bowl support extends radially outward from hollow adapter between the first and second sections. The second section includes an inner end near the bowl support, a closed outer end, and an opening through second section between the inner end and the closed outer end. The hollow bowl fixture is positioned on the bowl support and over the second section. The hollow bowl fixture includes a continuous sidewall that extends from an inwardly-directed upper flange encircling the closed outer end of the second section on an outer side of the opening to an inwardly-directed lower flange encircling the inner end of the second section on an inner side of the opening, and a smoke-collection chamber between the inwardly-directed upper flange and the inwardly-directed lower flange through which the second section extends from the inner end of the second section to the closed outer end of the second section. The inwardly-directed upper flange cooperates with the closed outer end of the second section to form a bowl for receiving a substance to be smoked and a smoke-inhalation pathway between the inwardly-directed upper flange and the closed outer end of the second section for the passage of inhalation smoke therethrough from the bowl to the smoke-collection chamber. The opening through second section between the inner end and the closed outer end is for the passage of inhalation smoke therethrough from the smoke-collection chamber to the hollow adapter. The hollow adapter is integrally formed of glass, and the hollow bowl fixture is integrally formed of glass.

BRIEF DESCRIPTION OF THE DRAWINGS

Referring to the drawings.

DETAILED DESCRIPTION

Figure 1:
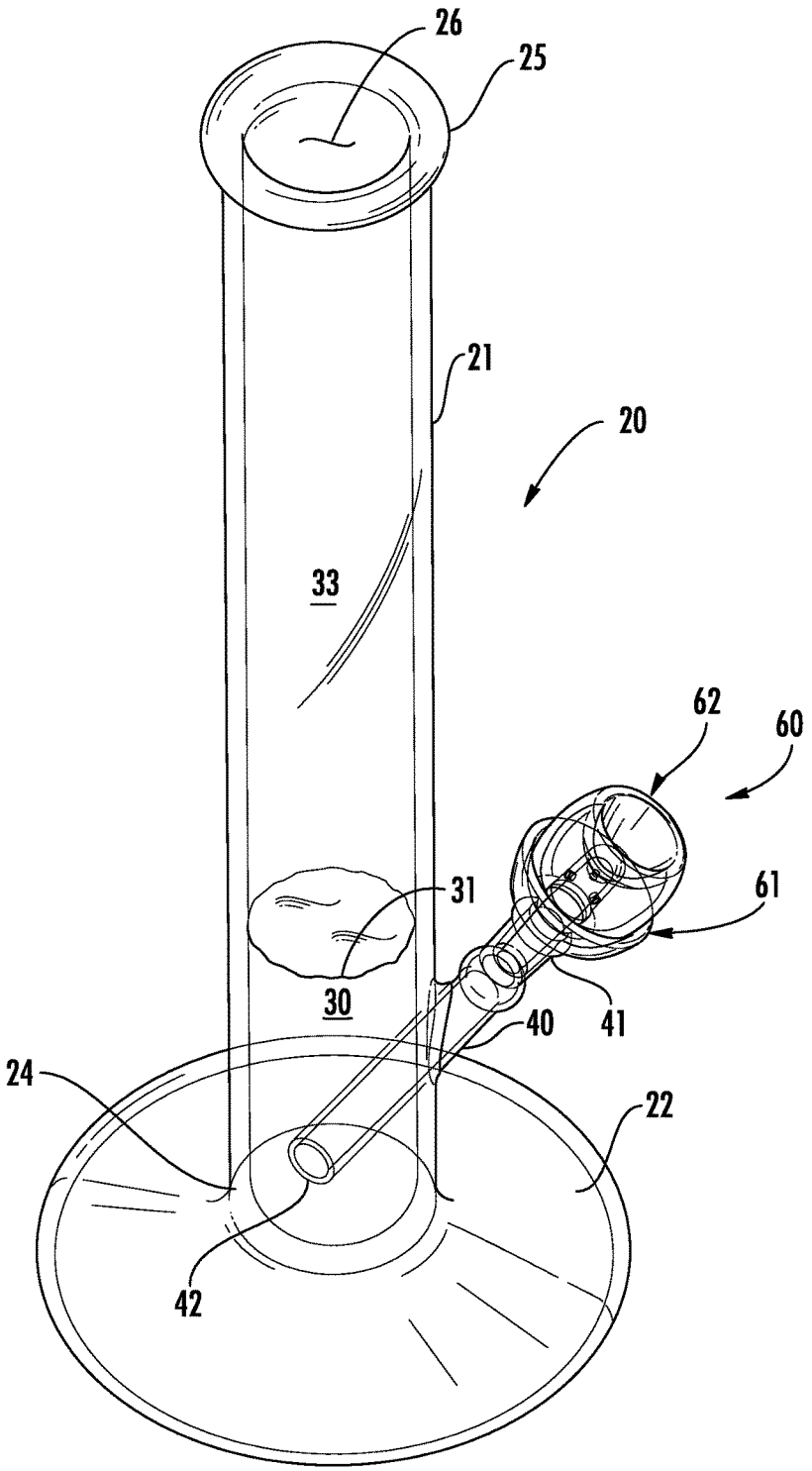
FIG. 1 is a perspective view of a water pipe including a water container coupled between a drawtube and a smoke inlet tube, and a bowl assembly constructed and arranged in accordance with the principle of the invention, the bowl assembly including a hollow adapter and a hollow bowl fixture.
Figure 5:
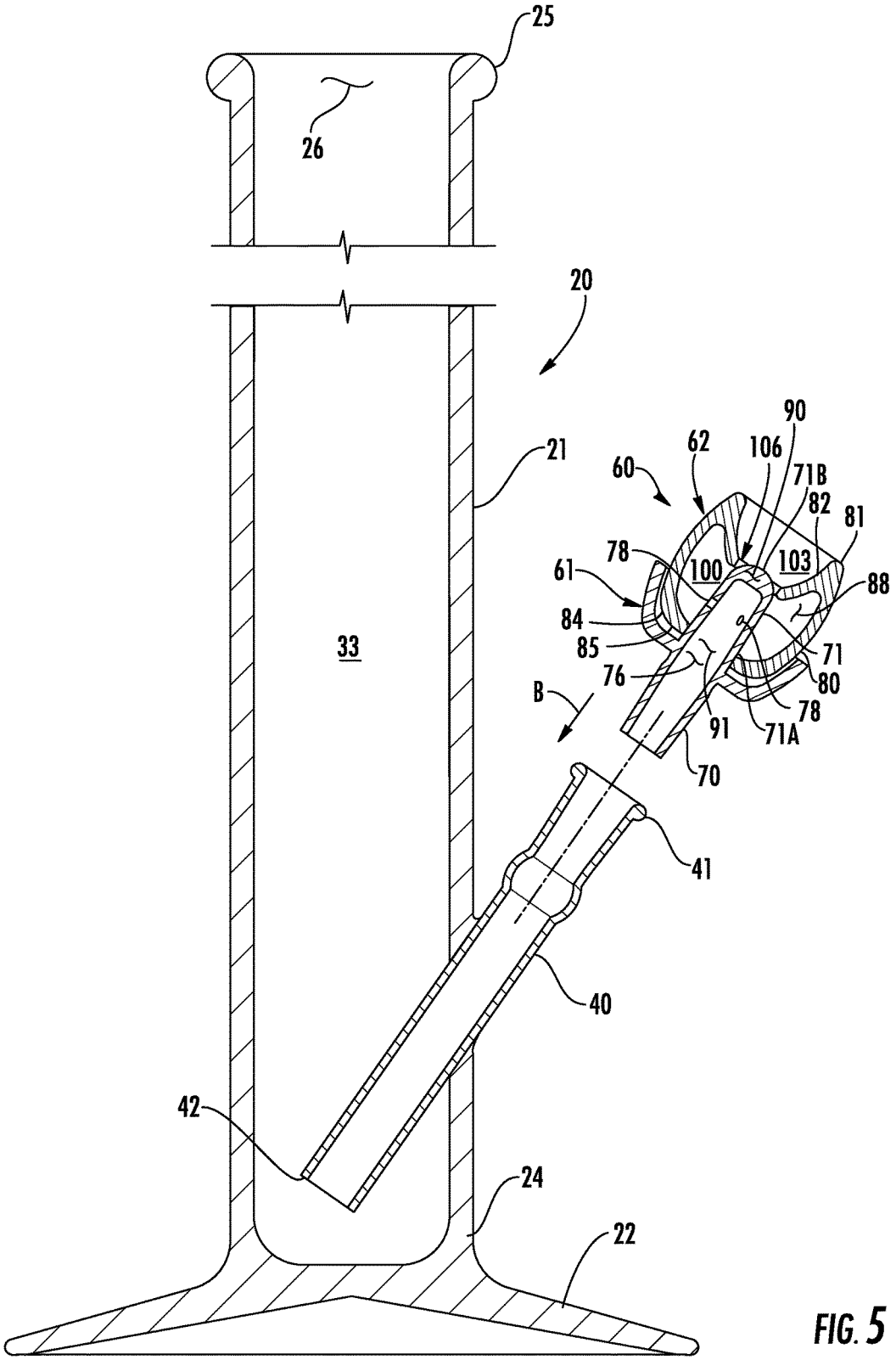
FIG. 5 is an enlarged section view illustrating the bowl assembly as it would appear assembled in preparation for connecting to the inlet of the smoke inlet tube.
Figure 6:
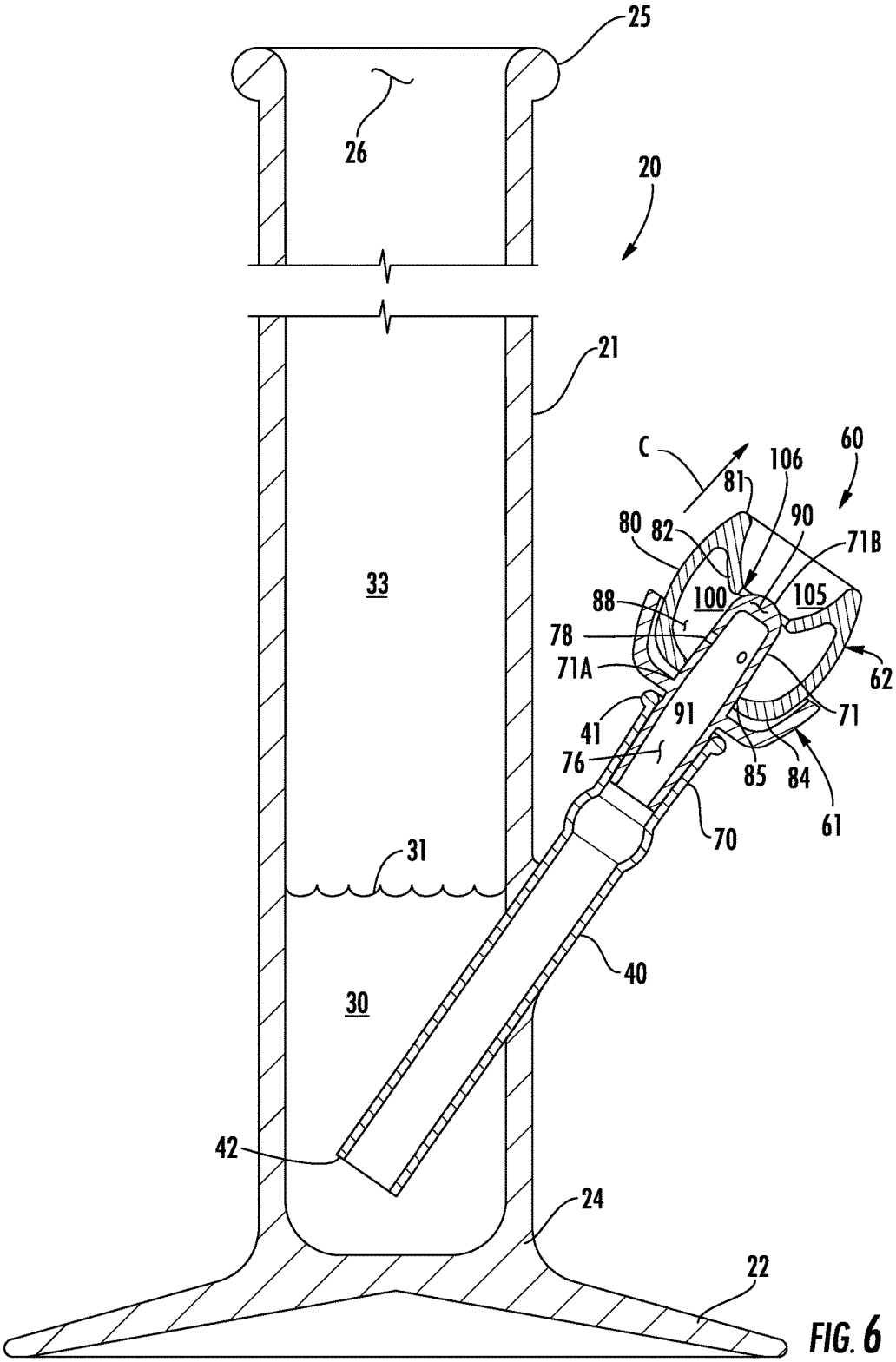
FIG. 6 is a view similar to that of FIG. 5 illustrating the bowl assembly as it would appear assembled and connected to the inlet of the smoke inlet tube.

Turning now to the drawings, in which like reference characters indicate corresponding elements throughout the several views, attention is first directed to FIGS. 1, 5, and 6, in which there is seen water pipe including tubular member 21 disposed vertically upon base 22. Lowermost end 24 of tubular member 21 is bonded to, integral with, or otherwise sealably secured to base 22. Uppermost end 25 of tubular member 21 provides opening 26 to receive the mouth and lips of the smoker. Uppermost end 25 of tubular member 21 is shaped to comfortably accommodate the mouth of the smoker, in which the smoker may thereby inhale and create a suction upon the contents of tubular member 21.

A lower portion of the tubular member 21 is container 21A, and an upper portion of tubular member 21 is drawtube 21B. In preparation for the use of water pipe 20, container 21A is filled with liquid 30 to level 31. Liquid 30, which is water or other liquid, occupying the lower portion or container 21A of the tubular member 21 creates above its surface 31 a volume or chamber 33 along drawtube 21B to opening 26.

Tubular member 21 carries smoke inlet tube 40 having open smoke inlet end 41 and open smoke outlet end 42. Container 21A is coupled between drawtube 21B and smoke inlet tube 40. Bowl assembly 60, which is constructed and arranged in accordance with the principle of the invention, is connected to smoke inlet tube 40. Bowl assembly 60 is used to hold a combusting substance, such as tobacco, herbs for smoking, or fruit for smoking. Bowl assembly 60 is connected to open smoke inlet end of smoke inlet tube 40. Smoke inlet tube 40 provides an internal passage from open smoke inlet end 41 to open smoke outlet end 42 beneath surface 31 of liquid 30 at container 21A near lowermost end 24 of tubular member 21. Smoke inlet tube 40 is conventionally in sealed relation to tubular member 21. During operation of water pipe 20, smoke is drawn from bowl assembly 60 through smoke inlet tube 40 from open smoke inlet end 41 to open smoke outlet end 42, wherein it emerges as bubbles that rise through liquid 30 in container 21A to surface 31 and into chamber 33. This use of water pipe 20 is well known, in which the smoke drawn through liquid 30 is drawn upwardly from surface 31 of liquid 30 through chamber 33 of drawtube 21B to the mouth of the smoker applied to opening 26.

Figure 2:
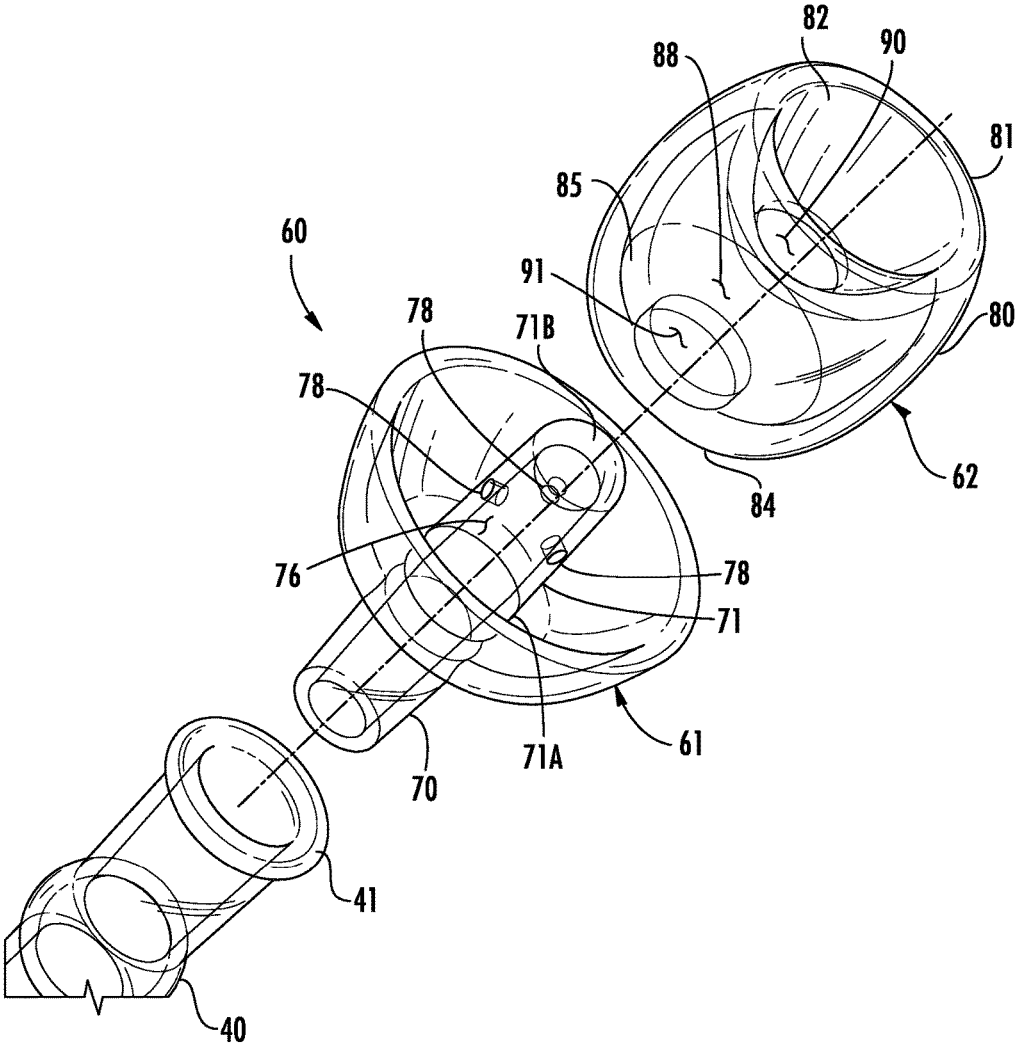
FIG. 2 is a perspective view of the bowl assembly of FIG. 1 show disassembled positioned adjacent to an inlet of the smoke inlet tube in preparation for installation.
Figure 3:
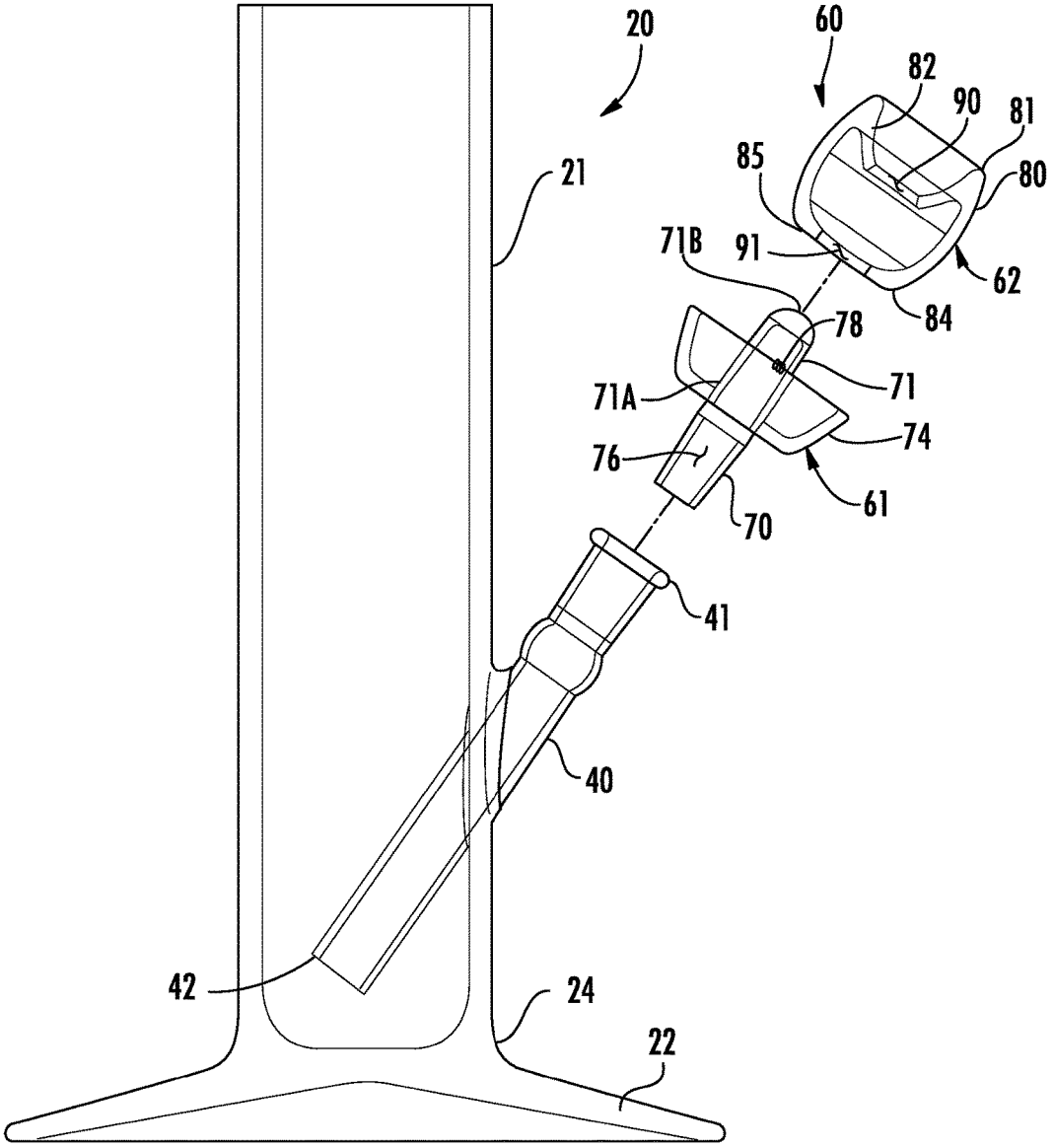
FIG. 3 is an enlarged side elevation view of the bowl assembly of FIG. 1 shown disassembled and positioned adjacent to an inlet of the smoke inlet tube in preparation for installation.
Figure 4:
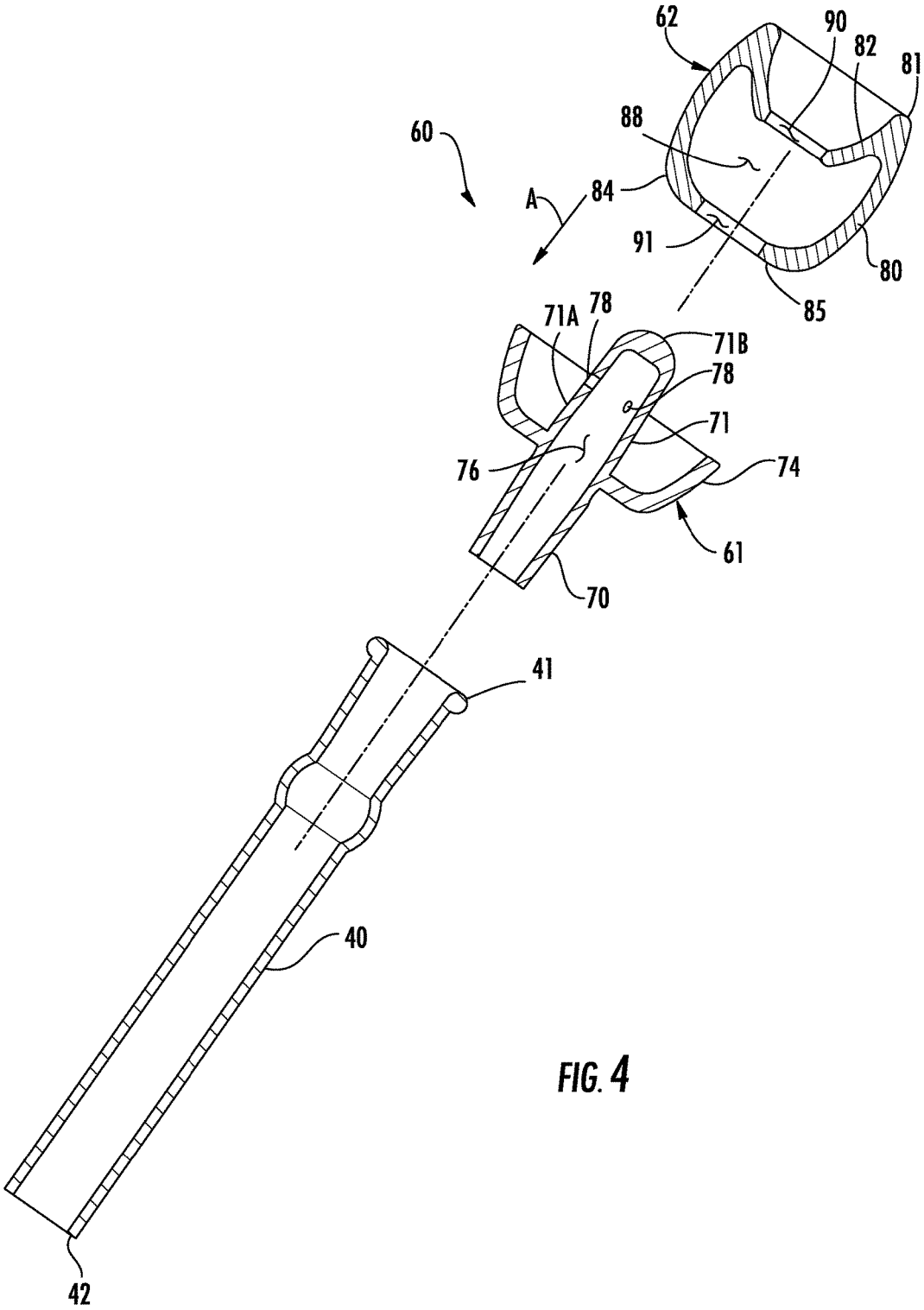
FIG. 4 is a section view of the embodiment of FIG. 2.

In FIGS. 2, 3, and 4, bowl assembly 60 includes adapter 61 and bowl fixture 62. Adapter 61 and bowl fixture 62 are each hollow in that they each have a space or cavity/chamber inside as described below, and are integrally formed of glass like that of conventional laboratory glassware.

Adapter 61 is a hollow tube and includes opposed tube sections, including section 70, and opposed section 71. Bowl support 74, which is generally bowl-shaped, extends radially outward from adapter 61 at an intermediate location of, or otherwise a middle of, adapter 61 between sections 70 and 71. Section 70 is adapted to be removably connected to open smoke inlet end 41 of smoke inlet tube 40, preferably via insertion of section 70 into open smoke inlet end 41. Section 70 is open and is a connector in the form of a ground glass connector commonly found in laboratory glassware, which is designed to be connected smoke inlet tube 40 via insertion into open smoke inlet end 41 as is shown in FIG. 6. Section 71 is an insert and has inner end 71A near bowl support 74 and opposed closed end 71B. Adapter 61 defines channel 76 that extends through sections 71 and 70 of adapter 61 from closed outer end 71B to and outwardly from section 70. A central axis extends through adapter 61 from closed outer end 71B to section 70 about which adapter 61 is symmetrical.

Openings 78 through section 71 to channel 76 are located between inner end 71A of section 71 and closed outer end 71B of section 70, and at an intermediate location between inner end 71A of section 71 and closed outer end 71B of section 71. In this example there are three openings 78 through adapter 61 to channel 76, which are equally spaced-apart. Openings 78 are for conducting inhalation smoke through section 71 of adapter 61 to channel 76. Less such openings 78 can be used, such as two openings 78 in one embodiment, and at least one opening 78 in another embodiment. More such openings 78 can be used as well, such as four openings 78 in one embodiment, five openings 78 in another embodiment, and even more than five such openings 78 in other embodiments.

Bowl fixture 62 is a hollow body. Bowl fixture 62 includes continuous sidewall 80 having upper end 81 with inwardly-directed upper flange 82, and lower end 84 with inwardly-directed lower flange 85, all of which cooperate define interior volume 88 of bowl fixture 62. Upper flange 82 defines opening 90 downwardly to interior volume 88, and lower flange 85 defines opening 91 upwardly to interior volume 88. Openings 90 and 91 are coaxial in that they reside along a common axis about which bowl fixture 62 is symmetrical.

Adapter 61 and bowl fixture 62 are connected together in gaseous communication to form bowl assembly 60. In FIG. 4, bowl fixture 62 is positioned with lower end 84 directed toward closed outer end 71B of section 71 aligning openings 90 and 91 with section 71. Bowl fixture 62 is moved in the direction of arrowed line A inserting section 71 closed end 71B first sequentially through openings 91 and 90, respectfully, positioning bowl fixture 62 lower end 84 first on bowl support 74. This positions bowl fixture 62 over section 71 in FIG. 5. So positioned in bowl support 74 and over section 71 so as to form assembled bowl assembly 60, lower end 84 is nested in direct contact against bowl support 74, and continuous sidewall 80 extends from inwardly-directed upper flange 82 that encircles closed outer end 71B of section 71 applied through opening 90 on an outer side of openings 78 to inwardly-directed lower flange 85 that encircles inner end 71A of section 71 extending through opening 91 on an opposite inner side of openings 78. Section 71 extends through interior volume 88 of bowl fixture 62 from opening 91 to opening 90. Smoke-collection chamber 100 is defined in interior volume 88 of bowl fixture 62. Smoke-collection chamber 100 in interior volume 88 of bowl fixture 62 is defined between inwardly-directed upper flange 82 and inwardly-directed lower flange 85 through which section 71 extends from inner end 71A at opening 91 to closed outer end 71B at opening 90, and between continuous sidewall 80 of bowl fixture 62 and the length of section 71 extending from opening 90 of inwardly-directed upper flange 82 to opening 91 of inwardly directed lower flange 85. Inwardly-directed upper flange 22 cooperates with closed outer end 71B of section 71 extending upwardly through opening 90 and occupying opening 90 to form bowl 105 for receiving a substance to be smoked, and smoke-inhalation pathway 106 for the passage of inhalation smoke therethrough from bowl 105 to smoke-collection chamber 100. Smoke-inhalation pathway 106 is between adapter 61 and bowl fixture 62. Specifically, smoke-inhalation pathway 106 is formed at opening 90 and is a gap between inwardly-directed upper flange 82 of bowl fixture 62 and closed outer end 71B of section 71 of adapter 61, and this gap is annular and continuous and unbroken and encircles outer end 71B of section 71 between outer end 71B and inwardly-directed upper flange 82. Openings 78 through section 71 between inner end 71A closed outer end 71B are between openings 90 and 91 and gaseously communicate between channel 76 of adapter 61 and smoke-collection chamber 100 for the passage of inhalation smoke therethrough from smoke-collection chamber 100 to channel 76 of adapter 61.

Having assembled bowl assembly 60 in FIG. 5, to connect bowl assembly 60 to smoke inlet tube 40 section 70 of adapter 61 is aligned with open smoke inlet end 41 and blow assembly 60 is simply moved in the direction of arrowed line B toward open smoke inlet end 41 inserting section 70 into open smoke inlet end 41 in FIG. 6 thereby coupling adapter 61 and bowl fixture 62 forming bowl assembly 60 in gaseous communication to smoke inlet tube 40 of water pipe 20 and thus, in turn, to water pipe 20. With bowl assembly 60 so connected to smoke inlet tube 40, water pipe 20 may be put to use by a smoker for smoking.

In FIG. 6, container 21A is filled with liquid 30 to level 31. Again, liquid 30, which is water or other liquid, occupying the lower portion or container 21A of the tubular member 21 creates above its surface 31 chamber 33 along drawtube 21B to opening 26. A substance to be smoked, such as tobacco, herbs for smoking, fruit for smoking, or other substance, is placed in bowl and is lit so as to become a combusting substance that generates smoke. The smoker places his mouth over opening 26 at uppermost end 25 of tubular member 21 and inhales. Smoke generated by the combusting substance in bowl 105 is drawn from bowl 105 to smoke-collection chamber 100 through smoke-inhalation pathway 106, which is drawn from smoke-collection chamber 100 to channel 76 of adapter 61 through openings 78. The smoke that is drawn into channel 76 draws through channel 76 from closed outer end 71B of section 71 and outwardly through section to the passage of smoke inlet tube 40 from open smoke inlet end 41 to open smoke outlet end 42 beneath surface 31 of liquid 30 at container 21A near lowermost end 24 of tubular member 21. The smoke is drawn from bowl assembly 60 through smoke inlet tube 40 from open smoke inlet end 41 to open smoke outlet end 42, where it emerges as bubbles that rise through liquid 30 in container 21A to surface 31, and the smoke drawn through liquid 30 is drawn upwardly from surface 31 of liquid 30 through chamber 33 of drawtube 21B to the mouth of the smoker applied to opening 26.

Some ash generated by the combusting substance in bowl 105 can tend to fall into smoke-collection chamber 100 through smoke-inhalation pathway 106. The ash that does fall through smoke-inhalation pathway 106 from bowl 105 falls downwardly through smoke inhalation chamber 100 where it collects atop inwardly-directed flange 85 at lower end 84 of bowl fixture 62. Smoke-collection chamber 100 is sufficiently large so to buffer and slow the draw of smoke therethrough so as to sufficiently limit or slow the speed and force of draw of the smoke through smoke-inhalation chamber 100 to channel 76 of adapter 61 through openings 78, which inhibits ash falling into smoke-inhalation chamber 100 from bowl 105 through smoke-inhalation pathway 106 from being drawn from through openings 78 from smoke-inhalation chamber 100 to channel 76 of adapter 76, so as to inhibit ash from passing through channel 76 of adapter 61 and into liquid 30 in container 21A via smoke inlet tube 40 during smoking, in accordance with the principle of the invention.

After smoking, bowl fixture 62 may be taken up by hand and simply removed from adapter 61 by pulling bowl fixture 62 away from adapter 61 in the direction of arrowed line C in FIG. 6. Having separated bowl fixture 62 from adapter 61, bowl fixture 62 may be cleaned of the ash in preparation for the next smoking. The bowl shape of bowl support 74 of adapter functions to collect falling ash from bowl fixture 62 at it is removed from adapter 61, and any ash collected in bowl support 74 may be removed prior to assembling bowl assembly 60 in preparation for the next smoking. If desired, a smoker may remove adapter 61 from open smoke inlet end 41 of smoke inlet tube 40 for cleaning. Having cleaned adapter 61 and bowl fixture 62, adapter 61 and bowl fixture 62 may be re-assemble and re-connected to smoke inlet tube 40 in the manner discussed above for use in the next smoking. If desired, bowl assembly 60 may be taken up by hand and removed from open smoke inlet end 41 of smoke inlet tube 40, and adapter 61 and bowl fixture 62 may be separated and cleaned and then reassembled and re-connected to open smoke inlet end 41 of smoke inlet tube 40 in preparation for the next smoking.

The embodiments of the present invention presented herein for illustrative purposes. Those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Improvements to a water pipe including a water container coupled between a drawtube and a smoke inlet tube, the improvements therein comprising:

a hollow adapter comprises a first section connected to the smoke inlet tube and an opposed second section, a bowl support extends radially outward from hollow adapter between the first and the second sections, the second section includes an inner end near the bowl support, a closed outer end, and an opening through the second section between the inner end and the closed outer end;

a hollow bowl fixture comprises a continuous sidewall that extends from an inwardly-directed lower flange to an inwardly directed upper flange, the inwardly-directed lower flange encircles a lower flange opening, and the inwardly-directed upper flange encircles an upper flange opening;

the hollow bowl fixture is positioned on the bowl support and over the second section, the second section extends through the hollow bowl fixture from through the lower flange opening to through the upper flange opening, the inwardly-directed upper flange encircles the closed outer end of the second section on a closed outer end side of the opening the inwardly-directed lower flange encircles the inner end of the second section on an inner end side of the opening, a smoke-collection chamber is between the inwardly-directed upper flange and the inwardly-directed lower flange through which the second section extends from the inner end of the second section extending through the lower flange opening to the closed outer end of the second section extending through the upper flange opening, and the opening of the second section is in the smoke-collection chamber between the inwardly-directed upper flange and the inwardly-directed lower flange;

the inwardly-directed upper flange cooperates with the closed outer end of the second section to form a bowl for receiving a substance to be smoked and a smoke-inhalation pathway between the inwardly-directed upper flange and the closed outer end of the second section for the passage of inhalation smoke therethrough from the bowl to the smoke-collection chamber; and the opening through the second section in the smoke-collection chamber between the inwardly-directed upper flange and the inwardly-directed lower flange is for the passage of inhalation smoke therethrough from the smoke-collection chamber to the hollow adapter for application to the smoke inlet tube of the water pipe.

2. The improvements according to claim 1, wherein the first section is connected to the smoke inlet tube via insertion of the first section into an open smoke inlet end of the smoke inlet tube.

3. The improvements according to claim 1, wherein hollow adapter is integrally formed of glass.

4. The improvements according to claim 1, wherein the hollow bowl fixture is integrally formed of glass.

5. A bowl assembly for a water pipe including a water container coupled between a drawtube and a smoke inlet tube, the bowl assembly comprises:

a hollow adapter comprises a first section adapted to be removably connected to the smoke inlet tube and an opposed second section, a bowl support extends radially outward from hollow adapter between the first and the second sections, the second section includes an inner end near the bowl support, a closed outer end, and an opening through the second section between the inner end and the closed outer end;

a hollow bowl fixture comprises a continuous sidewall that extends from an inwardly-directed lower flange to an inwardly directed upper flange, the inwardly-directed lower flange encircles a lower flange opening, and the inwardly-directed upper flange encircles an upper flange opening;

the hollow bowl fixture is positioned on the bowl support and over the second section, the second section extends through the hollow bowl fixture from through the lower flange opening to through the upper flange opening, the inwardly-directed upper flange encircles the closed outer end of the second section on a closed outer end side of the opening the inwardly-directed lower flange encircles the inner end of the second section on an inner end side of the opening, a smoke-collection chamber is between the inwardly-directed upper flange and the inwardly-directed lower flange through which the second section extends from the inner end of the second section extending through the lower flange opening to the closed outer end of the second section extending through the upper flange opening, and the opening of the second section is in the smoke-collection chamber between the inwardly-directed upper flange and the inwardly-directed lower flange;

the inwardly-directed upper flange cooperates with the closed outer end of the second section to form a bowl for receiving a substance to be smoked and a smoke-inhalation pathway between the inwardly-directed upper flange and the closed outer end of the second section for the passage of inhalation smoke therethrough from the bowl to the smoke-collection chamber; and the opening through the second section in the smoke-collection chamber between the inwardly-directed upper flange and the inwardly-directed lower flange is for the passage of inhalation smoke therethrough from the smoke-collection chamber to the hollow adapter.

6. The bowl assembly according to claim 5, wherein hollow adapter is integrally formed of glass.

7. The bowl assembly according to claim 5, wherein the hollow bowl fixture is integrally formed of glass.

* * * * *